US007108141B2

(12) United States Patent
Gonzalez-Rivera

(10) Patent No.: US 7,108,141 B2
(45) Date of Patent: Sep. 19, 2006

(54) FRAGILE ARTICLE TRANSPORTATION, DISPLAY AND STORAGE SYSTEM

(76) Inventor: Ani Gonzalez-Rivera, 317 S. Pleasant St., Amherst, MA (US) 01002

( * ) Notice: Subject to any disclaimer, the term of this patent is extended or adjusted under 35 U.S.C. 154(b) by 1067 days.

(21) Appl. No.: 09/971,792

(22) Filed: Oct. 5, 2001

(65) Prior Publication Data

US 2002/0046520 A1 Apr. 25, 2002

Related U.S. Application Data

(60) Provisional application No. 60/238,834, filed on Oct. 6, 2000.

(51) Int. Cl.
*B65D 85/48* (2006.01)

(52) U.S. Cl. ..... 211/94.01; 206/454; 206/594; 211/94.01; 211/162

(58) Field of Classification Search ..... 211/94.01, 211/45, 46, 47, 162; 206/521, 497, 499, 206/1.7, 453, 454, 583, 526, 1.8, 1.9, 205, 206/213.1, 204, 565, 449–456, 591; 40/783, 40/784, 785; 49/380
See application file for complete search history.

(56) References Cited

U.S. PATENT DOCUMENTS

| | | | | |
|---|---|---|---|---|
| 2,746,667 | A | 5/1956 | Murphy | |
| 2,847,726 | A * | 8/1958 | Frick | 52/207 |
| 2,895,599 | A * | 7/1959 | Moyer et al. | 206/454 |
| 2,939,603 | A * | 6/1960 | Young | 220/4.21 |
| 2,976,985 | A * | 3/1961 | Kraus | 206/454 |
| 3,213,576 | A * | 10/1965 | Davies | 52/134 |
| 3,251,460 | A * | 5/1966 | Edmonds | 206/523 |
| 3,266,656 | A * | 8/1966 | Kridle | 220/4.28 |
| 3,401,814 | A * | 9/1968 | Chiswell et al. | 220/4.33 |
| 3,566,561 | A * | 3/1971 | Tozer | 52/127.12 |
| 3,653,707 | A * | 4/1972 | Pile et al. | 294/67.1 |
| 3,655,034 | A | 4/1972 | Stollman et al. | |
| 3,735,952 | A | 5/1973 | Platus et al. | |
| 3,883,004 | A * | 5/1975 | Slaga | 211/162 |
| 4,013,170 | A * | 3/1977 | Hutterer | 206/521 |
| 4,030,603 | A | 6/1977 | Angell | |
| 4,156,498 | A * | 5/1979 | Miller | 294/151 |
| 4,373,643 | A | 2/1983 | Przytarski | |
| 4,446,968 | A * | 5/1984 | Bremer | 206/451 |
| 4,471,869 | A * | 9/1984 | Hasenfus | 206/1.7 |

(Continued)

OTHER PUBLICATIONS

David Erhardt, "Art in Transit: Material Conditions," *International Conference on the Packing and Transportation of Paintings*, (London, 1991), 25-36.

Timothy Green, "A Cushioned Transit Frame for Paintings," *International Conference on the Packing and Transportation of Paintings*, (London, 1991), 37-48.

(Continued)

*Primary Examiner*—Richard E. Chilcot, Jr.
*Assistant Examiner*—Lindsay M. Maguire
(74) *Attorney, Agent, or Firm*—Hoffmann & Baron, LLP

(57) ABSTRACT

An apparatus for holding a fragile item which includes a support frame and a support panel mounted within the support frame. The support frame includes at least one elongated, longitudinal channel on an exterior surface thereof to provide an area of attachment to the support frame. A fastener is provided to attach accessory components to the support frame. The fastener is preferably a spring nut and bolt arrangement, although any suitable fastener may be used. Such accessory components include substantially clear panels for displaying the items, shelf brackets, pipes and pipe fittings, covers, and elongated extensions to create a cavity box formed from at least two spaced apart support frames. The apparatus can be used to store, transport or display fragile items such as paintings, sculptures and tapestries.

15 Claims, 4 Drawing Sheets

U.S. PATENT DOCUMENTS

| | | | |
|---|---|---|---|
| 4,478,331 | A | 10/1984 | Ruin |
| 4,664,254 | A | 5/1987 | Sitwell et al. |
| 4,763,789 | A | 8/1988 | Questel et al. |
| 4,852,743 | A | 8/1989 | Ridgeway |
| 4,865,200 | A | 9/1989 | Sullivan et al. |
| 4,919,277 | A | 4/1990 | Jeruzal |
| 5,259,523 | A | 11/1993 | Scherb |
| 5,285,902 | A | 2/1994 | Tabuenca Garcia |
| 5,314,159 | A | 5/1994 | Szarata |
| 5,429,240 | A | 7/1995 | Biebel et al. |
| 5,518,118 | A | 5/1996 | Putz et al. |
| 5,655,662 | A | 8/1997 | Garcia |
| 5,803,258 | A | 9/1998 | Gonzalez-Rivera |

OTHER PUBLICATIONS

Paul J. Marcon, "A Circular Slide Rule for Protective Package Design," *International Conference on the Packing and Transportation of Paintings*, (London, 1991), 93-106.

Paul J. Marcon, "Shock, Vibration, and Protective Package Design," *International Conference on the Packing and Transportation of Paintings*, (London, 1991), 107-120.

Stephen Hackney and Paul J. Marcon, "Package Case Designs," *International Conference on the Packing and Transportation of Paintings*, (London, 1991), 69-71.

* cited by examiner

FRAGILE ARTICLE TRANSPORTATION, DISPLAY AND STORAGE SYSTEM

This application claims priority from U.S. Provisional Patent Application No. 60/238,834 filed on Oct. 6, 2000.

BACKGROUND OF THE INVENTION

1. Field of the Invention

The present invention relates to systems for holding items and more particularly, relates to systems for holding fragile items such as artwork and historical objects for storage, display and/or transporting among museums.

2. Description of the Prior Art

It is known that the safe handling of fragile items such as works of art, e.g., paintings, tapestries and sculptures, etc., during transport to and from studios and/or exhibits is a major concern of the owners of such pieces of artwork. Similar concern exists among owners of historical objects which must, at times, also be transported between various locations. Due to the fragile nature of thee items and, in most cases, the high value associated with them, much time and money is expended in providing systems that are intended to sufficiently protect the items during shipping and handling.

For instance, several methods and systems for transporting paintings have been employed in the prior art. One approach involves constructing a custom shipping frame and custom transport crate for each individual painting from a material such as wood. Each frame is typically handmade and sized to fit the single painting which will reside therein during shipping. The shipping frame is attached to a painting frame (e.g., canvas stretcher upon which the painting, itself, is mounted) via mounting hardware such as nuts and bolts. However, while such an approach attempts to ensure a properly fitted shipping container for the valuable item, the approach has several disadvantages. For instance, it is known that during unpacking of the painting from the custom frame, the loose mounting hardware may be accidentally dropped on the painting causing damage to the painting. Further, the time to construct a custom shipping frame and transport crate becomes severely prohibitive when a large number of paintings are to be transported. The time necessary to attach each object to its respective shipping frame is prohibitive and not cost effective. Because each custom shipping frame is constructed for one particular object, the reuse of such a shipping frame and crate is severely limited; modification and adjustments for reuse by other objects is not time or cost effective.

Since construction of the frame is wood, this natural resource is depleted and only minimally recyclable. Furthermore, a wood frame creates off-gassing, which prevents objects from being permanently stored therein. Also, the weight of the wood shipping frame adds substantially to the overall freight costs, especially for large exhibitions. In addition, the wood shipping frame transfers all shock and vibration directly to the object when said object is being handled in storage or being prepared for shipment or display. Again, while the preservation of the artwork is of paramount concern, the high cost and lengthy time associated with constructing multiple custom shipping frames for each painting is prohibitive.

Another approach which attempts to address the issue of reusability of shipping containers for artwork is disclosed in U.S. Pat. No. 5,285,902 to Tabuenca Garcia. Particularly, the '902 patent discloses a packaging system for paintings and other works of art which includes a metal tubular frame with a series of belts attached thereto. The belts are tensioned between buckles such that each belt forms a flat ring inside which a painting is accommodated. The painting is fastened by a series of half-clamps which are mounted on the belts and which attach to the sides of the painting with the belts criss-crossing over the surface of the painting. The metal tubular frame, with the painting supported therein, is then placed in matching receptacles within a custom transport vehicle on vibration-insulating supports. This approach allows for reuse of the packaging system each time the painting is transported and also permits varying sized paintings to be accommodated by adjusting the belts and clamps. However, the packaging system is flawed in that the belts tend to loosen and then rub against the artwork causing damage. Also, the artwork is subjected to stress and shaking when the belts are being initially tightened around it during packing. Still further, while the belt fastening approach may conserve time as compared to the custom frame approach, the time to properly position the painting within the frame and adjust all the belts is severely prohibitive when dealing with a large number of artwork pieces. The tightening and adjustment of the belts requires experienced personnel to direct these activities. The tubular frame and belts is limited to only square framed objects; odd shaped objects require having an additional shipping frame built (from wood), so the belts can be positioned therein. Because the tubular frame must travel within a matching metal transport crate, the weight of the combination frame and crate is more than a conventional wood crate, so the shipping cost is greater, and can be prohibitive with large exhibitions.

OBJECTS AND SUMMARY OF THE INVENTION

It is an object of the present invention to provide an apparatus for holding at least one fragile item which includes a support frame having at least one channel formed in a surface thereof thereby providing an area of attachment to any portion of the frame along the channel.

It is a further object of the present invention to provide a cavity box formed from two spaced-apart support frames connected by elongated members.

It is still a further object of the present invention to provide an apparatus for holding at least one fragile item which can be used to store, transport and/or display the fragile item.

It is yet another object of the present invention to provide an apparatus for holding at least one fragile item which creates a micro-climate within the apparatus.

In accordance with one form of the present invention, an apparatus for holding at least one fragile item includes a support frame and a support panel mounted within the support frame. The support frame includes at least one elongated longitudinal channel formed in an external surface thereof to provide an area of attachment to any portion along the channel of the support frame. In the preferred embodiment, the support frame is made from an extrusion and includes a plurality of channels such that each external face of the extrusion includes at least one channel therein. Also provided is a fastening means for attaching accessory parts to the support frame. Fastening means includes any known fastener, such as a spring nut and bolt arrangement.

The support frame further includes an interior surface having a means for mounting the support panel within the support frame. The mounting means includes an interior lip for supporting the support panel. Furthermore, the mounting means may include a further channel provided on an interior portion of the support frame for mounting a strip of metal or plastic thereto to secure the support panel to the interior lip.

In accordance with the present invention, the apparatus may include at least two spaced-apart support frames which are connected by elongated members to form a cavity box. The elongated members are attached to the support frames by fastening means to secure the members to the support frame channels. The cavity box may include one or more panels to enclose the box and/or a substantially transparent panel so that an item may be displayed within the cavity box. The cavity box may also include a series of shelves formed from additional support frames having support panels mounted therein. The shelves may include sliding tracks such as those used on drawers to permit the shelves to be partially withdrawn from the cavity box.

In accordance with the present invention, the apparatus may further include a support frame having panels mounted to opposite sides thereof to create a cabinet. A front panel may be formed of a substantially transparent material to permit viewing of the item within the cabinet. Furthermore, means for controlling a humidity may be provided within the cabinet enclosure thereby creating a micro-climate therein.

In accordance with another form of the present invention, the support frame may be mounted directly to a wall utilizing the channels formed therein. The support frame mounted to the wall may further include a substantially transparent panel covering a front portion of the support frame and also may include a gasket material provided between the substantially transparent panel and support frame. Furthermore, an enclosure frame may be provided over the substantially transparent panel and support frame to provide a finished look to the cabinet for display purposes.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
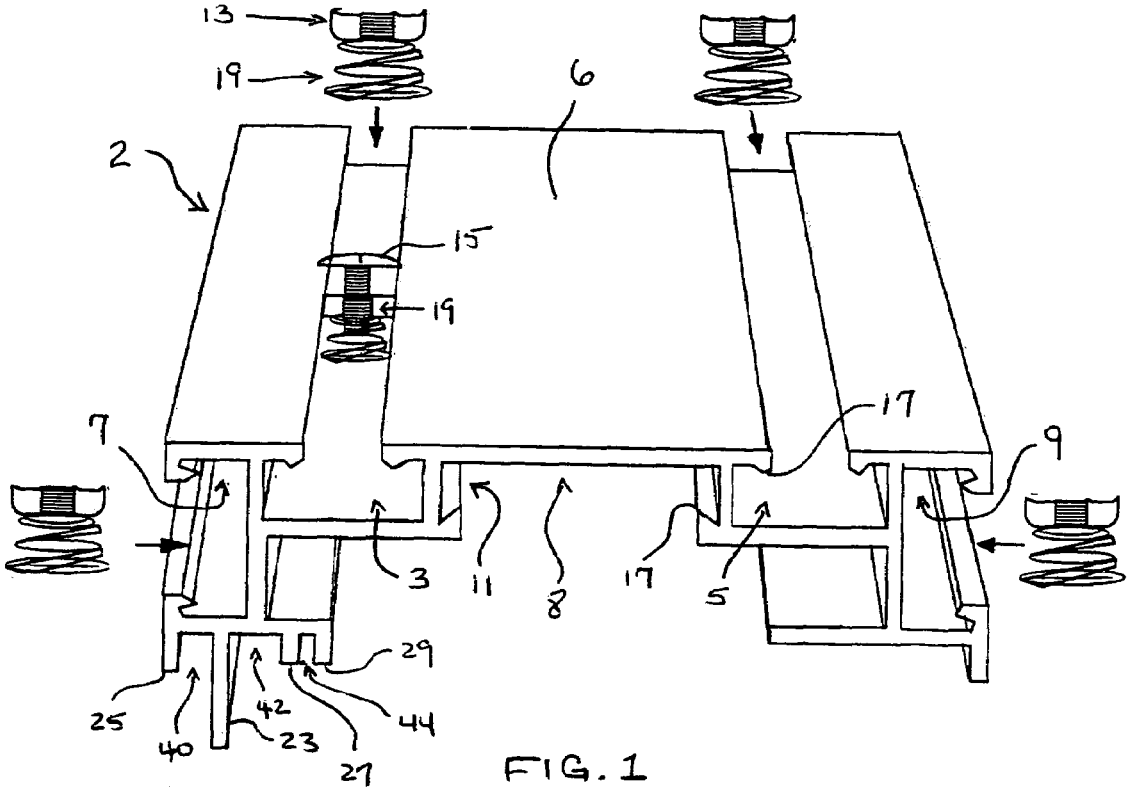
FIG. 1 illustrates a perspective view of an extrusion used to create a support frame, the perspective view also showing a cross-sectional view thereof.

The present invention discloses a system for shipping, handling, display and/or storing at least one fragile item, for example, a piece of artwork or historical object. The article transportation and storage system is generally disclosed in commonly owned U.S. Pat. No. 5,803,258. Accordingly, the disclosure of U.S. Pat. No. 5,803,258 is hereby incorporated by reference in its entirety for better understanding of the application.

Referring to U.S. Pat. No. 5,803,258, the present invention is directed to improvements thereto including modifications made to the support frame, reference numeral 16 in U.S. Pat. No. 5,803,258.

More specifically, the improved support frame includes a plurality of channels formed within a metal or plastic extrusion. The extrusion is connected at four corners to form a support frame for the support panel (identified by reference numeral 12 in U.S. Pat. No. 5,803,258). It is contemplated that the support panel may take many different forms and be made from any suitable material. The extrusion is generally hollow and designed to provide strength yet maintain the lightweight characteristics of the transportation and storage system.

Figure 2:
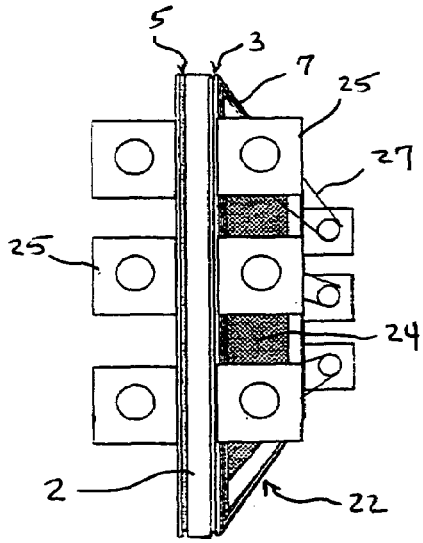
FIG. 2 illustrates an embodiment of the present invention for supporting rolled textiles or fabric material on the support frame in a vertical manner.

FIG. 1 is a perspective view including a cross-section of a first extrusion used to form the four sides of the support frame for the system. The extrusion 2 for this embodiment may be made of any thickness or any length to fulfill whatever design requirements are presented. FIG. 1 illustrates a first embodiment of an extrusion used to form the support frame 22 for the storage, display and/or transportation system. The extrusion 2 includes a plurality of channels 3, 5, 7 and 9 which allow the mounting of mechanical fastening means within the channels of the extrusion. More specifically, the extrusion 2 includes an outer surface 6 and an inner surface 8. Along the outer surface, the extrusion includes a pair of channels 3, 5 which extend spaced apart from and parallel to each other along a longitudinal portion of the extrusion. The inner surface 8 of the extrusion 2 includes an additional central channel 11. Opposing sides of the extrusion 2 each include at least one channel formed therein 7, 9. Each of the aforementioned channels include L-shaped legs having projections 17 thereon for engagement with a fastening means, such as a spring nut 13 and bolt 15. Furthermore, the inner surface of the extrusion 8 includes an area forming several channels 40, 42, 44 defined by an interior lip 23 and walls 25, 27, 29. The interior lip 23 and channel 42 provide a support channel for the support panel 24 shown in FIG. 2. The interior lip 23 and channel 44 allows a strip of metal, plastic, foam, rubber or other material to be mechanically adhered therein, thus securing the support member 24 to the interior lip 23 and possibly providing vibration dampening. The strip of metal, plastic, foam, rubber or the like may be bonded within the channel 44 via an epoxy adhesive, a bonding agent, riveted, fastened (by screws or bolts) or press-fitted therein.

The fastening means may include any type of nut/bolt arrangement, clip, or the like. In the preferred embodiment, the fastening means includes a threaded spring nut 13 and mating bolt 15, the spring nut including a small spring 19 fastened to the bottom thereof. The spring nut 13 has a slight angle in its design and is threaded to receive the mating threads of bolt 15. The spring nut 13 is dimensioned so that it can be placed longitudinally within any channel 3, 5, 7, 9, 11 and rotated half a turn so as to lock within the upstanding channel sidewalls. The extrusion channel sidewall may include a projecting angled tooth 17 and the spring nut 13 can include similar cooperating projecting teeth 16 so that the spring nut may be securely anchored within the channel.

The operation of the spring nut is such that when the nut is locked within the channel, the spring forces the threaded nut up against the interior of the channel walls so that the projecting portions of the spring nut and channel cooperatively lock the spring nut therein. By attaching the bolt to the anchored spring nut, various attachments can be secured to the support frame via the channel. Such attachments include shelf brackets, pipes and pipe fittings, straps for holding articles to the support panel, box covers made from a variety of materials, sliding tracks to form drawers, vibration dampers, casters and metal or plastic extensions which allow multiple support frames to be attached to each other in an endless number of units. Although the spring nut arrangement is described as the preferred fastening means, it is contemplated that any type of fastening means which allows securing articles to the support frame using the channels is contemplated by this invention.

Figure 3:
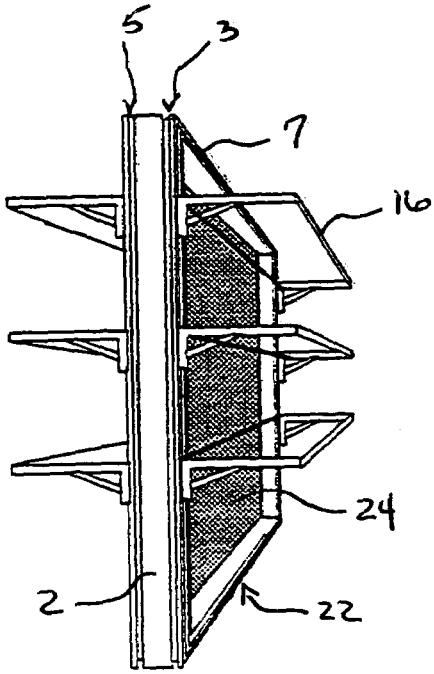
FIG. 3 illustrates a support frame positioned in a vertical configuration and including shelf brackets and shelves attached to opposite side of the support frame for mounting things thereon.

FIG. 3 illustrates a support frame formed from four pieces of extrusion 2 joined at their comers to form the support frame 22. Also illustrated in FIG. 3 is the support panel or member 24 which provides an anchoring surface for a variety of objects. More specifically, the support frame 22 is shown as a vertical frame including a plurality of pipe/tube supports 25 secured to opposing lateral sides and longitudinal sides of the support frame to permit storage or transport of rolled textiles or other fabric materials 27. It is also contemplated that a pair of pipe/tube supports 25 may be provided on a single side of the support frame which can be oriented in a horizontal plane to provide a shelf or tray. Accordingly, the support frame provides a suitable method of storage and transport. Furthermore, the frame may be dimensioned to permit display of the rolled textile directly thereon.

Figure 4:
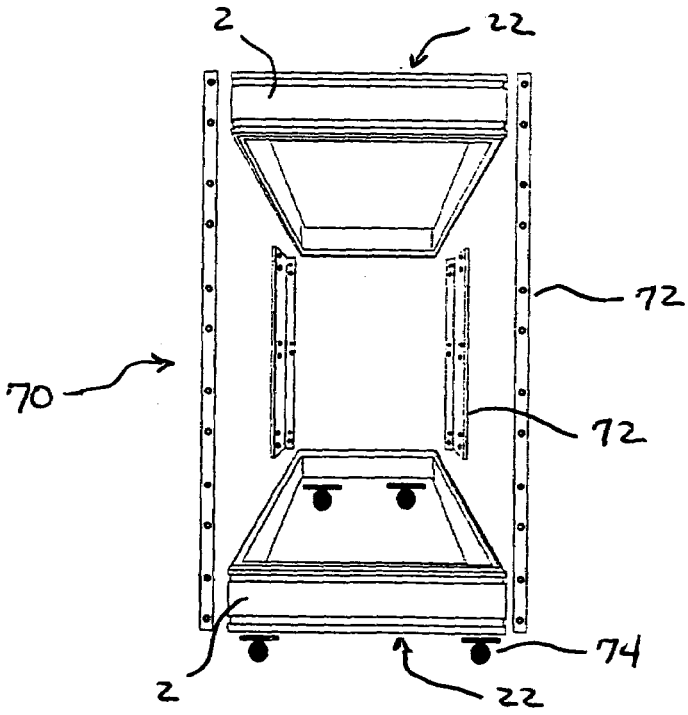
FIG. 4 illustrates a cavity box formed from a pair of support frames separated by vertical L-brackets attached to the comers thereof.

FIG. 4 illustrates a support frame configured as a rectangular vertical frame having shelves and shelf brackets 16 connected to the channels of the support frame extrusion 2. Alternatively, a foam cushioning/support material (not shown) may be provided to rest on top of the support panel 24. The cushioning/support material can be attached to the support panel via bolts which extend therethrough. An object of any shape can be further anchored to the support structure by utilizing ribbon, or webbing tie-down attachable to the support frame using the attachment channels 3, 5, 7, 9.

As earlier discussed, support frames 22 can be arranged to form various storage, display and/or transport configurations. For example, FIG. 4 illustrates a cavity box 70 formed by upper and lower support frames 22 spaced from each other and connected by support bars. The support bars may be in the form of L-brackets 72 mounted to each of the respective comers of the upper and lower support frames via the extrusion channels. The L-brackets 72 may be formed of any suitable material such as aluminum, steel or plastic. The cavity box 70 may be supplied with wheels 74 and/or forklift skids (not shown) to allow access and maneuvering of the cavity box. Many varied types of articles can be stored, displayed or transported in the cavity box. Objects may be anchored within the box in various manners such as anchoring to a support panel, providing shelves within the cavity box or providing a support frame using poles and/or straps and vibration dampening materials such as foam. Additionally, the cavity box may include attachable sidewalls to create a micro-climate container. One of the sidewalls may be formed from a substantially transparent material allowing the object within the cavity box to be viewed and/or displayed. Alternatively, the cavity box 23 may include adjustable, removable and/or slideable trays for storage, display, or transport of fragile articles thereon.

A plurality of support frames may be incorporated into a system for storage, display or transport of fragile articles in a manner similar to that shown in FIGS. 8, 9, 10 and 12A of commonly owned U.S. Pat. No. 5,803,258. For example, a container may be provided for housing an arrangement of the support frames in either a horizontal or vertical manner. The container may include casters for easy movement thereof.

Figure 5:
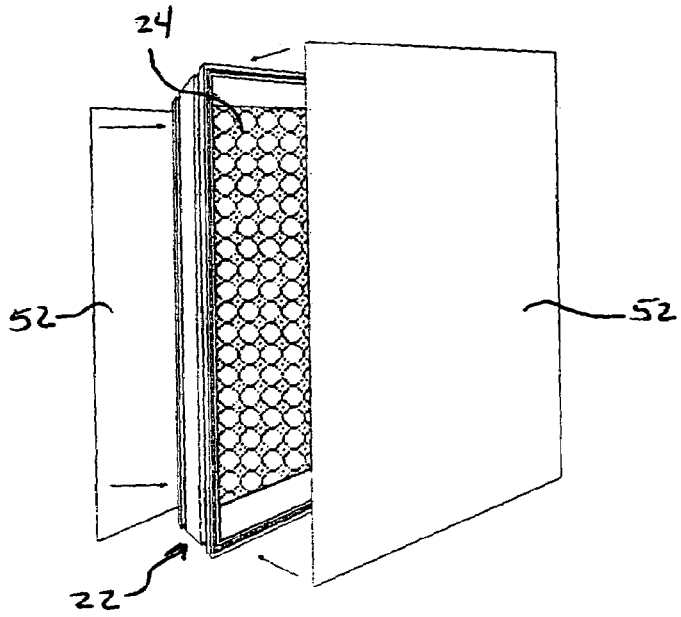
FIG. 5 illustrates an alternative embodiment of the support frame used as a micro-climate chamber.

Referring to FIG. 5, an alternative embodiment utilizing the support frame is illustrated. In the embodiment of FIG. 5, a support frame 22 includes the support panel 24 therein for mounting a fragile article thereon for storage, display and/or transport. The support frame 22 may include front and back protective covers 52 to provide a sealed micro-climate chamber. Utilizing ArtSorb™, a product which controls relative humidity at specific levels, the support frame can be sealed with the outer coverings and provided with ArtSorb™ within the enclosure to maintain a micro-climate for fragile or sensitive objects. This configuration permits museums or collections that have no controlled climate areas to store their most fragile or valuable pieces in a relatively controlled humidity environment. Furthermore, as an object is transferred from storage to crating, the climate is maintained consistently. ArtSorb™ is currently available in 5% increments of 40%–70% relative humidity. Additionally, the protective cover may include a gasket material to seal the environment. The protective cover can be formed of a transparent material, such as plexiglas so that the object can be viewed within the protective environment.

Figure 6:
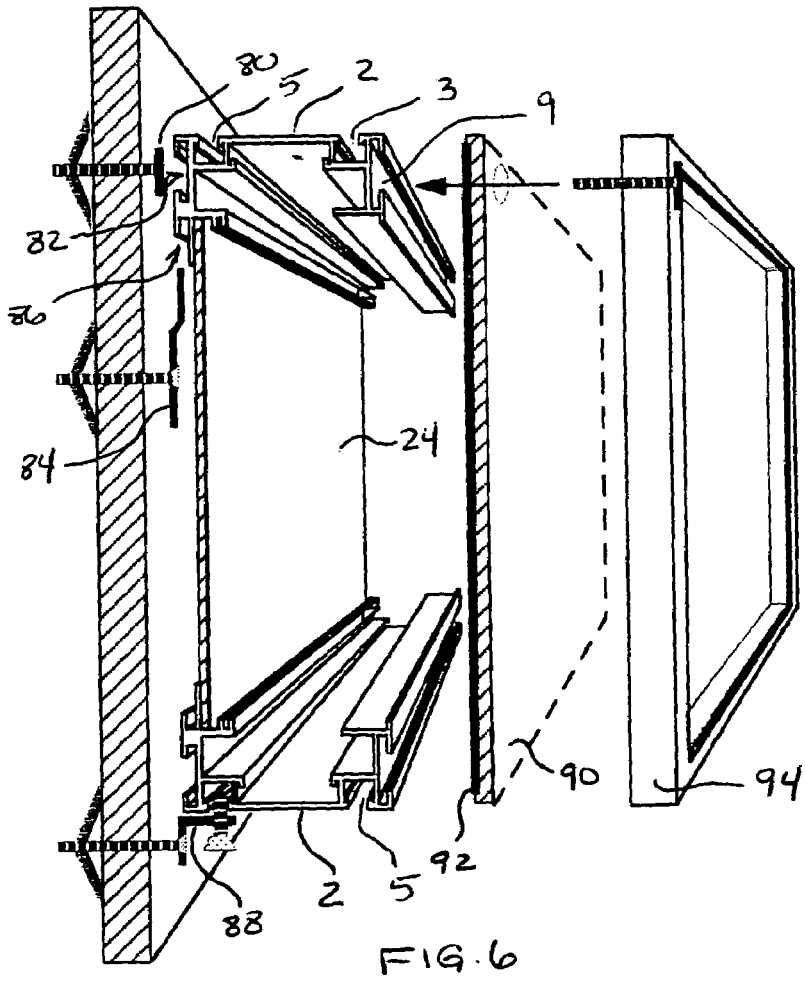
FIG. 6 illustrates a support frame formed in accordance with the present invention for use as a display cabinet.

FIG. 6 illustrates a further alternative embodiment showing the universal support frame 22 attached to a wall for use as a display cabinet or vitrine, using three optional mounting methods. A first method includes a "T" bolt 80 which is anchored to drywall or concrete block. The extension "T" member protrudes from the wall and extends into the channel 82, which when turned longitudinally within the channel, and rotated, locks within the channel. This approach allows for security installation of the support frame 22 to the wall, and permits for the display or exhibition of a number of objects placed on the support panel 24. Placing objects within the support frame 22 and attached to the support panel 24 eliminates the need to paint, patch and repair walls when rotating a variety of different size objects or displays.

A second method for installation of the support frame 22 to the wall is to provide a metal plate 84. The metal plate 84 is anchored to drywall or concrete block and an extension plate of the member protrudes from the wall and extends into the channel 86, which is on the rear of the support frame 22. The plate supports the frame 22 along the entire back thereof.

A third method for installation of the support frame 22 to the wall is to provide a metal "L" plate 88. The metal "L" plate 88 is anchored to drywall or concrete block using any known fastening means. The "L" extension plate member protrudes from the wall similar to a small support shelf, allowing the support frame 22 to rest on the edge of the protruding "L". The frame 22 can be further secured from theft or vandalism by passing a bolt through the "L" plate 88 and into the bottom channel provided in the support frame.

In addition to the placement of objects on support frame 22 and support panel 24, objects may be further protected from dust, pollutants, water, vermin, theft, and vandalism when sealed with a clear glazing material (plexiglas) 90, or other material, which includes a silicone gasket 92 placed facing the extrusion on the face of the support frame 22. A further protective layer of security is added when a welded, finished enclosure frame 94 is attached to the support frame 22 via a security bolt passing through the enclosure frame 94, through the plexiglas glazing, and into the channel provided on the support frame 22. The enclosure frame 94 also provides a finished look to the protective display unit.

Figure 7:
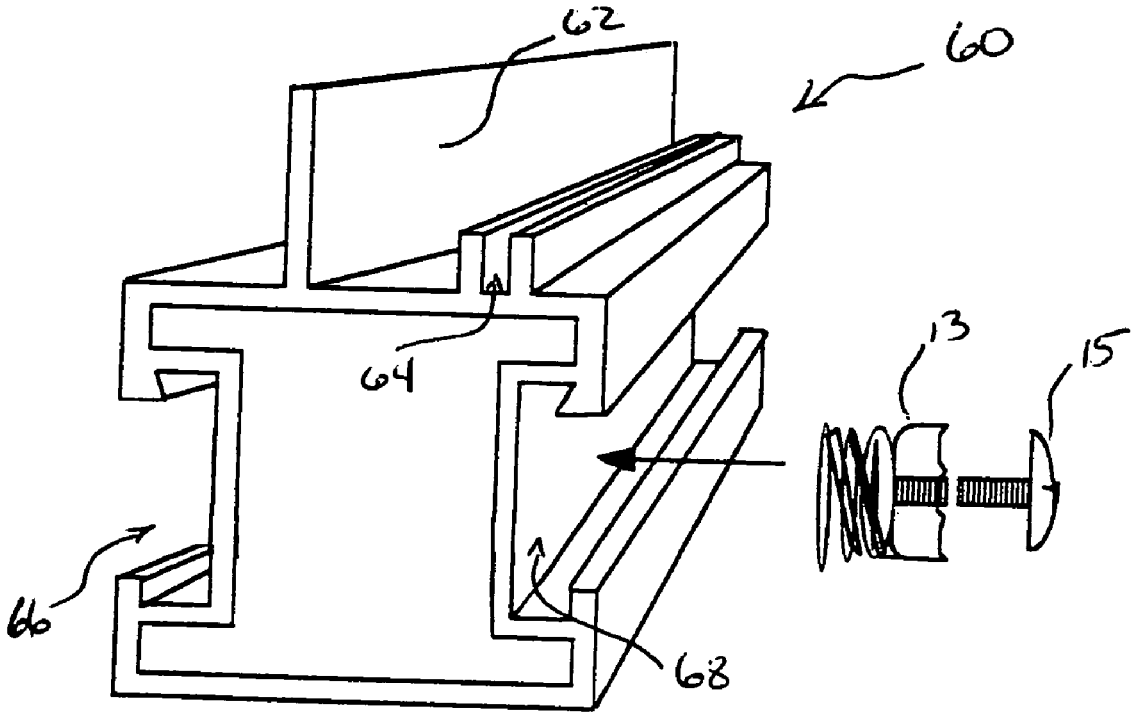
FIG. 7 illustrates an alternative embodiment of an extrusion member used to form a support frame.

Referring to FIG. 7, an alternate embodiment of the support frame extrusion is shown. The extrusion 60 may be made of any length or thickness to fulfill desired design requirements. Importantly, the extension 60 includes a pair of oppositely opposed channels 66, 68 thereby providing a location for mounting fastening means to the support frame as described above with respect to FIG. 1. The interior of the extrusion 60 allows a multitude of materials to rest on an interior lip 62. A support panel or member 24 is attachable to the interior surface of the extrusions which form the support frame. For example, the support frame formed by the extrusion may include a screen or other support material which creates a tray or shelf configuration in which the user is able to attach objects directly to the support member. Both the type of material and the thickness thereof used as the support member can vary according to the final dimension of the support frame extrusion. The extrusion preferably includes a secondary channel 64 which allows a strip of metal or plastic to be mechanically adhered thereto, thus securing the support member to the resting lip 62. The strip of metal or plastic may be bonded within the secondary channel via an epoxy adhesive or other known bonding agents, riveted, fastened or press-fit therein.

It is to be understood that in view of the object to be mounted to the support member within the support frame, the member can be made from various materials and have a different thickness to support heavier or lighter objects. For example, if a heavy object is to be mounted, the support screen can be made of a metal material and have a thickness which can support the heavy object. To the contrary, if a light object is to be mounted within the system of the present invention, a support member may be made of a polypropylene or plastic material to reduce the weight thereof yet still provide sufficient strength for supporting the object within the system.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An apparatus for holding at least one fragile item comprising:

a support frame including an interior slot formed by a pair of opposed side walls; and a support panel mounted in said interior slot of the support frame, wherein the support frame further includes at least one elongated longitudinal channel formed in each of at least three external surfaces thereof thereby providing an area of attachment via a fastening device to any portion along the channel of the support frame, each of said elongated longitudinal channels including a pair of legs to partially enclose a portion of said channels for receiving said fastening device.

2. The apparatus as defined in claim 1, wherein the support frame is an extrusion.

3. The apparatus as defined in claim 1, further comprising a fastening means provided in the channels of the support frame for attaching accessory parts to the support frame.

4. The apparatus as defined in claim 3, wherein the fastening means comprises a spring nut and bolt arrangement.

5. The apparatus as defined in claim 1, wherein an interior surface of the support frame includes means for mounting the support panel within the support frame.

6. The apparatus as defined in claim 1, further comprising means for mounting the support frame to a wall.

7. The apparatus as defined in claim 6, further comprising a substantially transparent panel mounted to the support frame to create a display case.

8. The apparatus as defined in claim 7, further comprising a gasket provided between the substantially transparent panel and the support frame.

9. An apparatus for holding at least one fragile item comprising:

a support frame;

a support panel mounted within the support frame, wherein the support frame includes at least one elongated longitudinal channel formed in an external surface thereof thereby providing an area of attachment to any portion along the channel of the support frame; and at least two spaced apart support frames connected by elongated members to form a cavity box wherein the elongated members are attached to the support frames by fastening means provided in the at least one channel of the support frame.

10. The apparatus as defined in claim 9, further comprising at least one panel member mounted to an exterior of said cavity box.

11. The apparatus as defined in claim 9, further comprising at least one further support frame mounted within the cavity box for mounting a fragile article thereon.

12. An apparatus for holding at least one fragile item comprising:

a support frame;

a support panel mounted within the support frame, wherein the support frame includes at least one elongated longitudinal channel formed in an external surface thereof thereby providing an area of attachment to any portion along the channel of the support frame;

a substantially transparent panel mounted to the support frame to create a display case; and an enclosure frame secured to the at least one channel of the support frame.

13. An apparatus for holding at least one fragile item comprising:

a support frame;

a support panel mounted within the support frame, wherein the support frame includes at least one elongated longitudinal channel formed in an external surface thereof thereby providing an area of attachment to any portion along the channel of the support frame; and pipe/tube supports mounted to the at least one channel of the support frame.

14. An apparatus for holding at least one fragile item comprising:

a support frame, wherein the support frame includes a channel on each of the front and back surface thereof and further comprising front and back panels secured to the channels in the support frames to create an enclosure; and a support panel mounted within the support frame, wherein the support frame includes at least one elongated longitudinal channel formed in an external surface thereof thereby providing an area of attachment to any portion along the channel of the support frame.

15. The apparatus as defined in claim 14, further comprising means for controlling a humidity within the enclosure.

* * * * *

UNITED STATES PATENT AND TRADEMARK OFFICE

CERTIFICATE OF CORRECTION

PATENT NO. : 7,108,141 B2
APPLICATION NO. : 09/971792
DATED : September 19, 2006
INVENTOR(S) : Ani Gonzalez-Rivera It is certified that error appears in the above-identified patent and that said Letters Patent is hereby corrected as shown below:

In Column 1, Line 21, the patent now reads "thee" the patent should read --these--.

Signed and Sealed this

Sixth Day of March, 2007

JON W. DUDAS
*Director of the United States Patent and Trademark Office*